United States Patent [19]

Roney

[11] Patent Number: 4,922,395

[45] Date of Patent: May 1, 1990

[54] ELECTRICALLY CONDUCTIVE TRACK CIRCUIT FOR SHOCK MOUNTING A BULB, A BLANK FOR SUCH A TRACK CIRCUIT, METHOD OF MAKING SAME, AND A LAMP ASSEMBLY HAVING SAME

[76] Inventor: Troy L. Roney, 239 Sunrise Dr., Madison, Ind. 47250

[21] Appl. No.: 296,067

[22] Filed: Jan. 12, 1989

[51] Int. Cl.[5] ..... F21V 15/04

[52] U.S. Cl. ..... 362/390; 362/61; 362/226; 362/306; 313/51

[58] Field of Search ..... 313/51, 113; 362/61, 362/80, 217, 223, 226, 306, 310, 390, 369

[56] References Cited

U.S. PATENT DOCUMENTS

| | | | |
|---|---|---|---|
| 3,327,110 | 6/1967 | Baldwin | 362/390 X |
| 4,282,566 | 8/1981 | Newman | 362/390 X |
| 4,437,145 | 3/1984 | Roller et al. | 362/306 |

*Primary Examiner*—Stephen F. Husar
*Attorney, Agent, or Firm*—Jon C. Winger

[57] ABSTRACT

A conductive track circuit for shock mounting a light bulb within a lamp housing particularly well suited for use on motor vehicles to protect the light bulb from shock loads and vibrations. The conductor track circuit includes mounting flanges for attaching the track circuit to the lamp housing, electrical conductor strip members integral with the mounting flanges for connecting the track circuit to a source of electrical energy, and resilient arms integral with the mounting flanges for holding the light bulb in position and absorbing vibrations and shocks. A blank from which the track circuit is formed includes three coplanar conductor tracks each having a mounting flange with an integrally formed terminal strip member extending from the mounting flange and an integrally formed arm extending from the mounting flange, the conductor tracks being in spaced juxtaposition and connected together by integral webs.

19 Claims, 4 Drawing Sheets

ELECTRICALLY CONDUCTIVE TRACK CIRCUIT FOR SHOCK MOUNTING A BULB, A BLANK FOR SUCH A TRACK CIRCUIT, METHOD OF MAKING SAME, AND A LAMP ASSEMBLY HAVING SAME

BACKGROUND OF THE INVENTION

The present invention relates to lamps used on motor vehicles having brackets for shock isolating the light bulb, and more particularly to an electrically conductive shock mounting bracket, a lamp having such a bracket, and a blank from which such a bracket is made.

Various different lamps, such as stop, turn, and tail lamps, used on motor vehicles are subjected to vibrations and shock loads as the vehicles are driven. The shock loads and vibrations are transmitted to the lamps mounted on the vehicle and are one cause of shortened light bulb life.

There have been many proposals for isolating light bulbs from vibrations and shock loads. The following U.S. Patents illustrate various prior proposals for shock mounting older conventional light bulbs having a screw or bayonette base: U.S. Pat. No. 3,067,326 issued on Dec. 4, 1962 to G.A. Knapp; U.S. Pat. No. RE. 30,498 reissued on Jan. 27, 1981 to George D. Baldwin; U.S. Pat. No. 4,176,391 issued on Nov. 27, 1979 to Geroge J. Kulik; U.S. Pat. No. 4,231,081 issued Oct. 28, 1980 to Joseph V. Borruso; U.S. Pat. No. 4,282,566 issued on Aug. 4, 1981 to Charles J. Newman; and U.S. Pat. No. 4,390,936 issued on June 28, 1983 to Charles A. Slater.

More recently, so-called baseless cartridge light bulbs have been used in place of the older bulbs having a screw-type or bayonet-type mounting base. One such typical baseless cartridge light bulb is disclosed in U.S. Pat. No. 4,061,940 issued on Dec. 6, 1977 to Wagner Electric Corp. Typical baseless cartridge light bulbs include a cylindrical glass envelope with opposite reduced or flattened ends. Electrical resistance filaments extend through the glass envelope with filament pins at the opposite ends of the envelope to be connected by wires to a source of electrical energy. U.S. Pat. No. 4,437,145 which issued on May 13, 1984 to Philip C. Roller features one proposal for shock mounting such a baseless cartridge bulk in a lamp housing.

The present invention provides a shock absorbing mounting bracket particularly well suited for mounting a baseless-type light bulb which is electrically conductive eliminating the need for separate electrical wires.

The present invention also provides a blank from which the novel shock absorbing mounting bracket is made.

The present invention further provides a lamp assembly incorporating the novel shock absorbing mounting bracket wherein the baseless-type bulb is oriented to take advantage of its filament column strength.

SUMMARY OF THE INVENTION

More particularly, the present invention provides in one embodiment an electrically conductive bracket for shock mounting a cartridge light bulb and the like in a lamp housing comprising: a plurality of electrical conductor tracks in spaced apart juxtaposition; each of the conductor tracks comprising: a mounting flange portion to be fastened to the lamp housing to hold the conductor track in position in the lamp housing; means for attaching the mounting flange portion to the lamp housing; an electrical terminal strip member integrally attached to and extending outwardly from one side edge of the mounting flange portion; a shock absorbing resilient arm having a predetermined spring rate integrally attached to and extending upwardly from the mounting flange portion; and, bulb securing means at the distal end of the arm for attachment to one end of the cartridge bulb.

In another embodiment, the present invention provides a blank from which an electrical conductive bracket for shock mounting a cartridge light bulb and the like is formed, comprising: a flat, planar first electrical conductor track element comprising: a mounting flange element; an electrical terminal strip element integral with and extending from one edge of the mounting flange element; and, an arm element integrally formed with and extending from another edge of the mounting flange element; a flat, planar second electrical conductor track element in spaced apart, coplanar relationship to the first electrical conductor track element comprising: a mounting flange element; an electrical terminal strip element integral with and extending from one edge of the mounting flange element in parallel relationship to the electrical terminal strip element of the first electrical conductor track element; and an arm element integrally formed with and extending from another edge of the mounting flange element in the opposite direction of the arm element of the first electrical conductor track element.

In yet another embodiment, the present invention provides a motor vehicle lamp assembly having a cartridge type bulb, comprising: a lamp housing; an electrically conductive bracket fastened to the lamp housing having at least two parallel, resilient arms with their distal ends spaced apart by a distance substantially equal to the length dimension of the cartridge type bulb; bulb securing means at the distal ends of the arms for securing the cartridge type bulb between and spanning the distance between the distal ends of the arms; and the arms of the bracket are oriented in a vertical plane when the lamp is on a motor vehicle.

BRIEF DESCRIPTION OF THE DRAWINGS

A better understanding of the present invention will be had upon reference to the following description in conjunction with the accompanying drawings wherein like numerals refer to like parts through the several views and in which.

DETAILED DESCRIPTION OF THE PREFERRED EMBODIMENTS

Figure 1:
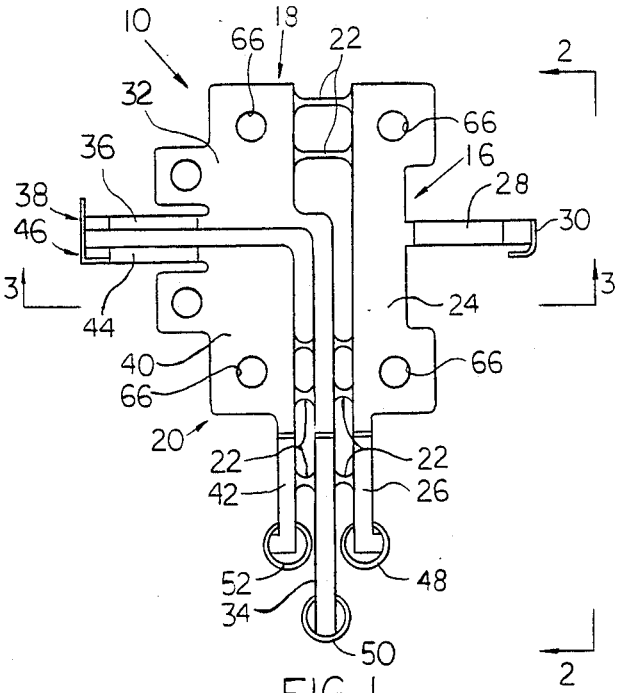
FIG. 1 is a plan view of the shock mounting bracket of the present invention.

With reference to FIGS. 1–4 and 5–9, there is shown an electrically conductive bracket, generally denoted as the numeral 10, fabricated of an electrically conductive material such as, for example, copper, and also for shock mounting a baseless type cartridge light bulb 12, and similarly constructed bulbs, in a lamp housing 14. The conductive bracket 10 is illustrated for use with a two filament or dual intensity bulb 12 typically used for stop/turn/tail lamps of a motor vehicle.

The electrically conductive bracket 10 includes a first electrical conductor track 16, a second electrical conductor track 18, and a third electrical conductor track 20. During the manufacture of the bracket 10, the first, second, and third electrical conductor tracks 16, 18, 20 are interconnected by integral webs 22 which are subsequently removed to separate the electrical conductor tracks from each other.

The first electrical conductor track 16 includes a flat mounting flange portion 24 to be fastened to the lamp housing 14 to hold the first conductor track 16 in position in the lamp housing 14. An electrical terminal strip member 26 is integrally formed with and extends from a side edge of the mounting flange 24, and an arm 28 is integrally formed with and extends upwardly from another side edge of the mounting flange 24. A bulb securing means 30 is integral with the distal end of the arm 28 for attachment to one end of the bulb 12. The second electrical conductor track 18 is in spaced juxtaposition to the first conductor track 16. The second electrical conductor track 18 includes a flat mounting flange portion 32, coplanar with and in spaced apart relationship to the mounting flange portion 24 of the first conductor track 16. The flat mounting portion 32 is to be fastened to the lamp housing 14 to hold the second conductor track 18 in position in the lamp housing 14. An electrical terminal strip member 34 is integrally formed with and extends from a side edge of the mounting flange 32 in spaced juxtaposition to the electrical terminal strip member 26 of the first conductor track 16. An arm 36 is integrally formed with and extends upwardly from another side edge of the mounting flange 32 spaced from the arm 28 of the first electrical track 16 with the distal end of the arm 36 of the second conductor track 18 spaced from the distal end of the arm 28 of the first conductor track 16 by a distance approximately equal to the length dimension of the bulb 12. A bulb securing means 38 is integral with the distal end of the arm 36 for attachment to the opposite end of the bulb 12 to which the bulb securing means 30 of the first conductor track 16 is attached. The third electrical conductor track 20 is in spaced juxtaposition to both the first conductor track 16 and the second conductor track 18. The third electrical conductor track 20 includes a flat mounting flange portion 40, coplanar with and in spaced apart relationship to the mounting flange portion 24 of the first conductor track 16 and also coplanar with and in spaced apart relationship to the mounting flange portion 32 of the second conductor track 18. The flat mounting portion 40 is to be fastened to the lamp housing 14 to hold the third conductor track 20 in position in the lamp housing 14. An electrical terminal strip member 42 is integrally formed with and extends from a side edge of the mounting flange 40 in spaced juxtaposition to the electrical terminal strip member 34 of the second conductor track 18. An arm 44 is integrally formed with and extends upwardly from another side edge of the mounting flange 40 in closely adjacent, spaced juxtaposition to the arm 36 of the second conductor track 18 and spaced from the arm 28 of the first electrical conductor track 16 with the distal end of the arm 44 of the third conductor track 20 spaced from the distal end of the arm 28 of the first conductor track 16 by a distance approximately equal to the length dimension of the bulb 12. A bulb securing means 46 is integral with the distal end of the arm 44 also for attachment to the opposite end of the bulb 12 to which the bulb securing means 30 of the first conductor track 16 is attached. When a light bulb 12 is installed, for example, the arms 28 and 36 are electrically connected to a first filament of the bulb 12 completing an electrical circuit therethrough, and the arms 28 and 44 are electrically connected to a second filament of the bulb 12 completing an electrical circuit therethrough.

Figure 2:
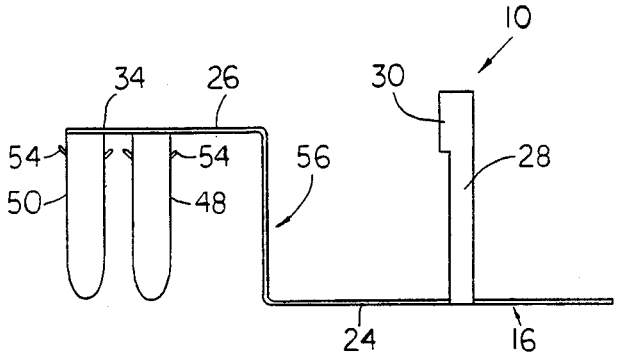
FIG. 2 is a side view of the shock mounting bracket as seen in the direction of arrows 2—2 in FIG. 1.

With reference to FIGS. 1 and 2, the electrical terminal strip member 26 of the first conductor track 16 has a depending electrical terminal 48 integrally formed at its distal end, the electrical terminal strip member 34 of the second conductor track 18 has a depending electrical terminal 50 integrally formed at its distal end, and the electrical terminal strip member 42 of the third conductor track 20 has a depending electrical terminal 52 integrally formed at its distal end. As shown, the electrical terminals 48, 50, and 52 are mutually parallel, and arranged in a triangular array with the electrical terminals 48, 50, 52 at the apexes of the array. The electrical terminals 48, 50, and 52 are shown as being generally cylindrical in transverse cross-section and are adapted to be plugged into a female electrical socket 64 of the lamp housing 14 as will hereinafter be discussed. As can be best seen in FIG. 2, each of the terminals 48, 50, 52 includes ears 54 for frictionally gripping a female socket 64 of the lamp housing 14 to prevent the terminals 48, 50, 52 from moving inwardly of the lamp housing 14 when final electrical connection is made. The ears 54 further function to fix the electrical tracks 16, 18, 20 in place in the lamp housing 14.

With continued reference to FIG. 2, the electrical terminal strip members 26, 34, and 42 are each formed with opposite double bends to form a step formation 56 so that a portion of the length of the strip members 26, 34, 42 proximate the distal ends thereof is in a plane parallel to the coplanar mounting flange portions 24, 32, 40.

Figure 3:
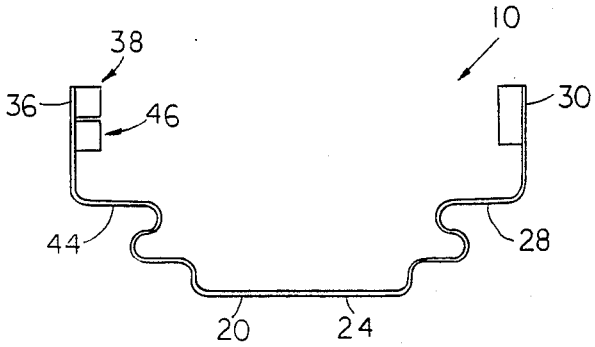
FIG. 3 is a view of the shock mounting bracket as seen in the direction of arrows 3—3 in FIG. 1.

Now with reference to FIG. 3, each of the arms 28, 36, 44 are configured to provide the necessary spring constant for absorbing shock and vibration through deflection of the arms. As shown, each of the arms 28, 36, 44 is configured to include serpentine curves along at least a portion of its length between its proximal and distal ends which are used to absorb shock and vibration through deflection. This serpentine configuration prevents energy from being transmitted from the housing 14 to the bulb 12. Preferably, the spring constant of the arms 28 is equal to the sum of the spring constants of the arms 36 and 44. Also, preferably, the spring constant of the arms 28, 36, 44 is equal in both the X-axis (horizontal plane in FIG. 3) and the Y-axis (vertical plane in FIG. 3).

Figure 5:
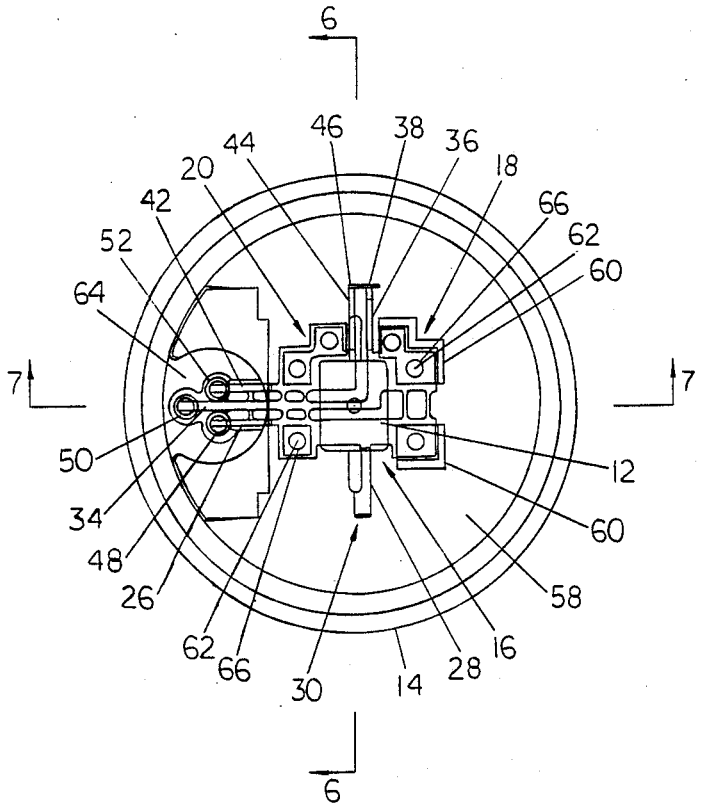
FIG. 5 is a front view of a lamp assembly having the shock mounting bracket of the present inveniton.
Figure 6:
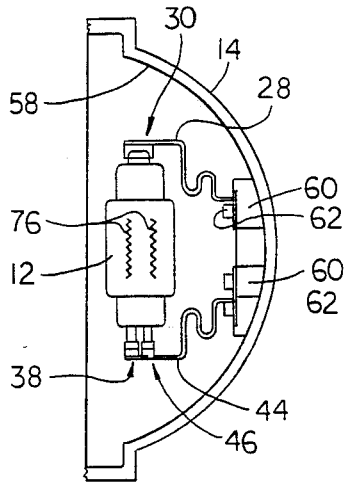
FIG. 6 is a cross-sectional view of the lamp assembly as seen in the direction of arrows 6—6 in FIG. 5.
Figure 7:
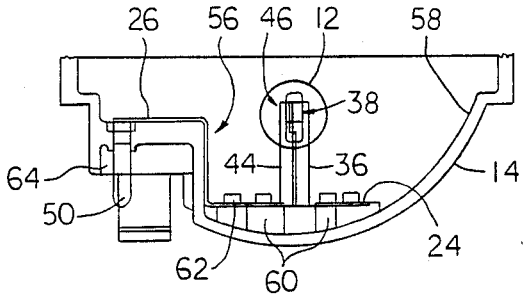
FIG. 7 is a cross-sectional view of the lamp assembly as seen in the direction of arrows 7—7 in FIG. 5.

Now with reference to FIGS. 5, 6 and 7, there is shown the bracket 10 comprised of the first conductor track 16, second conductor track 18, and third conductor track 20 installed in the lamp housing 14. As shown, the lamp housing 14 has a concave reflecting surface 58 having a pedestal 60 at the center for mounting the bracket 10 in front of the concave reflecting surface 58. The pedestal 60 includes a plurality of mounting studs 62 in a predetermined array projecting outwardly from the top side of the pedestal 60. The lamp housing 14 further includes, for example, a female electrical socket 64 at its concave surface spaced radially from the pedestal 60. The female socket 64 is electrically connected to a source of electrical energy. The flat mounting flange portions 24, 32, 40 of the conductor tracks 16, 18, 20, respectively, each have mounting stud receiving apertures 66. The conductor tracks 16, 18, 20 are positioned at the concave surface of the lamp housing 14 with the mounting flange portions 24, 32, 40 positioned in overlaying relationship to the top side of the pedestal 60 with the mounting studs 62 projecting through the stud receiving apertures 66 and with the depending electrical terminals 48, 50, 52 received in the female socket 64 such that the arms 28, 36, 44 project outwardly of the concave surface 58 of the lamp housing 14. The first, second, and third conductor tracks 16, 18, 20 are secured in position by, for example, sonically swaging, or cold or hot staking the projecting ends of the mounting studs 62. The webs 22 interconnecting the first, second, and third electrical conductor tracks 16, 18, 20 can now conveniently be removed from the bracket 10 by the same operation and at the same time that the projecting of the studs are upset. For example, the sonic process used to swage the mounting studs 62 can also be used to sever the webs 22 separating the first, second, and third electrical tracks 16, 18, and 20 from each other. By way of further example, if the mounting studs 62 are upset by staking, the same die can be used to sever the webs 22. The webs 22 holding the electrical conductor tracks 16, 18, 20 together as a unit until they are secured in place in the lamp housing 14 insure proper mutual alignment of the tracks 16, 18, 20.

With reference to FIGS. 5 and 6, it can be more clearly seen that the arm 28 of the first electrical conductor track 16 and the pair of adjacent arms 36 and 44 of the second and third electrical conductor tracks 18 and 20, respectively, are in an imaginary vertical plane extending therethrough such that they support the baseless type cartridge light bulb 12 with its filaments 76 in a vertical plane when the lamp housing 14 is installed on a motor vehicle as opposed to the convention orientation with its filaments in a horizontal plane. The vertical mounting of the bulb 12 increases its resistance to mechanical failure because it has a greater strength as a column than as a beam.

Figure 9:
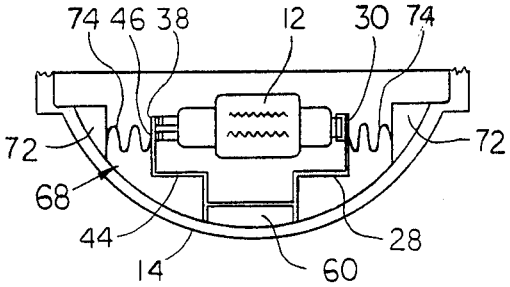
FIG. 9 is a cross-sectional view of the lamp assembly illustrating another embodiment of the optional feature of FIG. 8.
Figure 8:
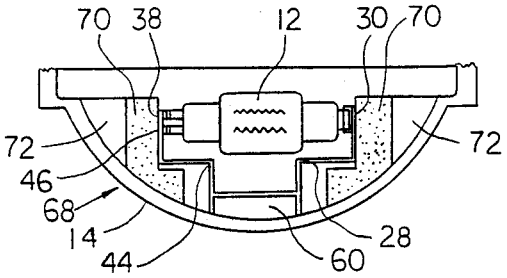
FIG. 8 is a cross-sectional view of a lamp assembly similar to that shown in FIG. 6 illustrating another embodiment of an optional feature.

Now with reference to FIGS. 8 and 9, supplemental damper means, generally denoted as the numeral 68, can be included between each of the arms 28, 36, 44 and the concave surface 58 of the lamp housing 14 to dampen the vibratory motion of the arms 28, 36, 44 caused by vibration and shock loads imparted to the lamp. In FIG. 8, the dampening means 68 is illustrated as resilient pads 70, for example of foam, located between each of the arms 28, 36, 44 and adjacent flanges 72 fastened to the concave surface 58 of the housing 14. In FIG. 9, the dampening means 68 is illustrated as coil springs 74 each connected at one end to an arm 28, 36, 44 and at the other end to the adjacent flange 72. The damper means 68 minimize the decay time of oscillations or vibrations of the arms 28, 36, 44 which allows the bulb 12 to return to equalibrium position as quickly as possible.

Figure 4:
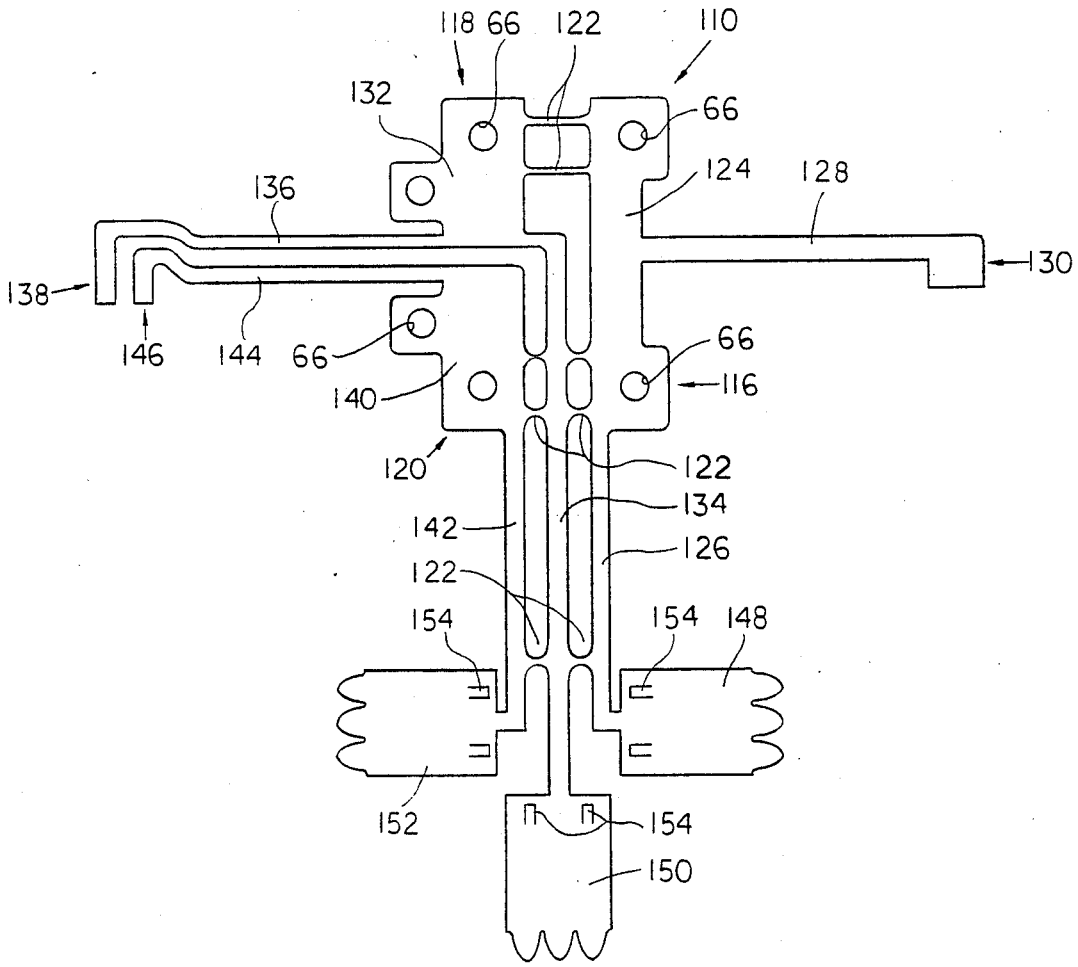
FIG. 4 is a plan view of a blank from which the shock mounting bracket of FIGS. 1–3 is made.

Now with reference to FIG. 4, there is shown a blank, generally denoted as the numeral 110, from which the bracket 10 is ultimately formed. The blank can be stamped or otherwise be cut from a sheet of electrically conductive stock such as copper. The blank 110 comprises a flat planar first electrical conductor track element 116, a flat planar second electrical conductor track element 118, and a flat planar third electrical track element 120 in mutual coplanar spaced apart relationship and fastened together by webs 122. The first planar electrical conductor track element 116 includes a mounting flange element 124, an electrical terminal strip element 126 integral with and extending from the mounting flange element 124, and an arm element 128 integrally formed with and extending from the mounting flange element 124 at 90 degrees to the extending electrical strip element 126. An electrical terminal element 148 is integral with and extends from the distal end of the terminal strip element 126 at approximately 90 degrees to the longitudinal axis of the strip element 126 and generally parallel to the extending arm element 128. The second planar electrical conductor track element 118 includes a mounting flange element 132, an electrical terminal strip element 134 integral with and extending from the mounting flange element 118 in spaced, parallel, juxtaposition to the electrical terminal strip element 126 of the first conductor track element 116, and an arm element 136 integrally formed with and extending from the mounting flange element 132 at 90 degrees to the electrical terminal strip element 134 and 180 degrees to the arm element 128 of the first conductor track element 116. An electrical terminal element 150 is integral with and extends from the distal end of the terminal strip element 134 generally coaxial with the longitudinal axis of the termainal strip element 134. The third planar electrical conductor track element 120 includes a mounting flange element 140, an electrical terminal strip element 142 integral with and extending from the mounting flange element 120 in spaced, parallel, juxtaposition to the electrical terminal strip element 134 of the second conductor track element 118, and an arm element 144 integrally formed with and extending from the mounting flange element 140 in spaced close juxtaposition to the arm element 136 of the second conductor track element 118. An electrical terminal element 152 is integral with and extends from the distal end of the terminal strip element 142 at approximatley 90 degrees to the longitudinal axis of the terminal strip element 142 and generally parallel to the arm element 136.

To form the bracket 10, the arm elements 128, 136, 144 are bent upwardly at approximately their integral juncture with the mounting flange elements 124, 132, 140, respectively, and can also be formed with sinuous curves. The terminal elements 148, 150, 152 are each bent downwardly at their integral juncture with the terminal strip elements 126, 134, 142, respectively, and are formed into, for example, a cylindrical configuration to fit into the female socket 64 of the lamp housing 14. The appropriate step formation 56 is formed in the electrical terminal strip elements 126, 134, 142 to conform to the geometry of the lamp housing 14 so that the mounting flanges 24, 32, 40 will rest on the lamp housing pedestal 60 and the electrical terminals 48, 50, 52 will fit into the female lamp housing socket 64.

Figure 10:
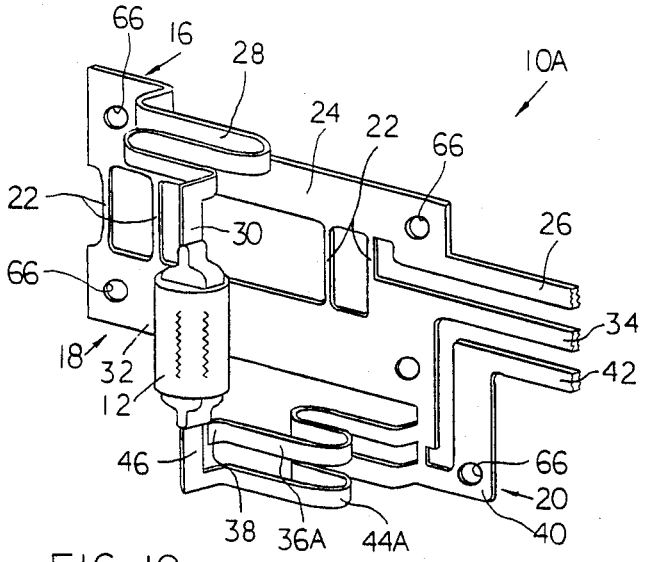
FIG. 10 is a perspective view of another embodiment of the shock mounting bracket of the present invention with portions broken away for clarity; and, FIG. 11 is a plan view of a blank from which the shock mounting bracket of FIG. 10 is made.

With reference to FIG. 10, there is shown a somewhat different embodiment of an electrically conductive bracket 10A, fabricated of an electrically conductive material, which is substantially identical to the electrically conductive bracket 10 shown in FIGS. 1–3 except for the orientation of the arms 28, 36, and 44 which are denoted as the numerals 28A, 36A, and 44 A in FIG. 10 for purposes of differentiation. All of the other elements of the bracket 10A are the same as the bracket 10 and, therefore, for the sake of brevity identical elements are identified by identical numerals in FIGS. 1, 2, 3 and 10, and a detailed discussion thereof will not be repeated.

In the bracket 10 of FIGS. 1-3, the longitudinal axes of the arm 28 and pair of arms 36, 44 are in longitudinal alignment with each other across the width of the bracket 10 whereas in the bracket 10A of FIG. 10, the longitudinal axes of the arm 28A and pair of arms 36A, 44A are parallel to each other. As also can be seen in the bracket 10 the longitudinal axes of the arm 28 and pair of arms 36, 44 are perpendicular to the longitudinal axis of the terminal strip members 26, 34, 42 whereas in the bracket 10A the longitudinal axes of the arm 28A and pair of arms 36A, 44A are parallel to the longitudinal axis of the terminal strip members 26, 34, 42.

The bracket 10A is installed in the lamp housing 14 in the same manner as is the bracket 10 as shown in FIGS. 5, 6, 7, 9, and 10.

Figure 11:
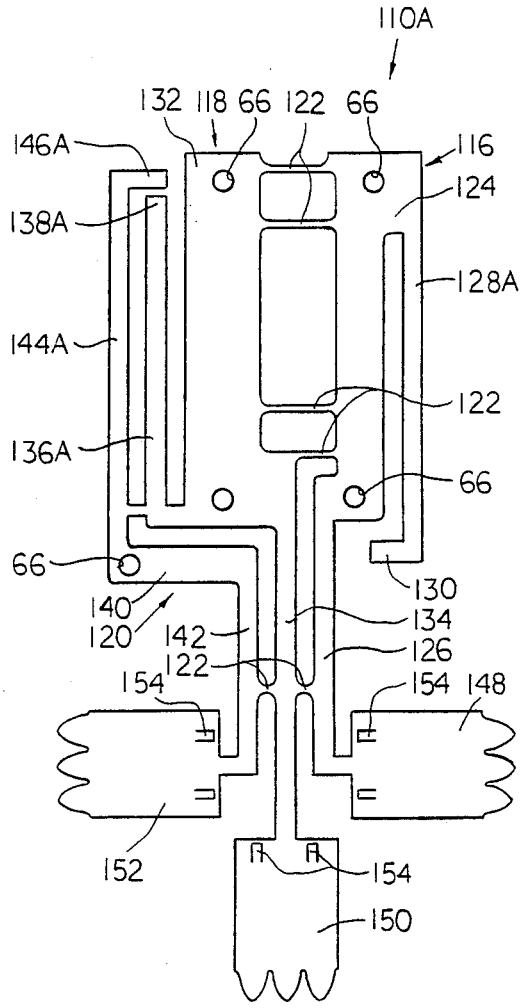

Now with reference to FIG. 11, there is shown a blank, generally denoted as the numeral 110A, from which the bracket 10A is ultimately formed. The blank 110A is substantially identical to the blank 110 shown in FIG. 4 except for the orientation of the arm elements 128, 136, and 144 which are denoted as the numerals 128A, 136A, and 144A in FIG. 11 for the purposes of differentiation. All of the other elements of the blank 110A are the same as the bracket 110 and, therefore, for the sake of brevity, identical elements are identified by identical numerals in FIGS. 4 and 11, and a detailed discussion thereof will not be repeated.

Whereas in the blank 110, the arm element 128 extends from the mounting flange element 124 at 90 degrees to the electrical strip element 126, the arm element 136 extends from the mounting flange element 132 at 90 degrees to the electrical terminal strip element 134, and the arm element 144 extends from the mounting flange element 140 at 90 degrees to the electrical terminal strip element 142, in the blank 110A the arm element 128A extends from the mounting flange element 124 parallel to the electrical strip element 126, the arm element 136A extends from the mounting flange element 132 parallel to the electrical terminal strip 134, and the arm element 144A extends from the mounting flange element 140 parallel to the electrical terminal strip element 142. Thus, in the blank 110A the arm elements 128A, 136A, 144A are all parallel to each other. The primary advantage of the blank 110A over the blank 110 is a material savings because the blank 110A can be formed from a smaller sized stock of material than the blank 110.

The above described electrically conductive mounting track 10, 10A is particularly suited for shock mounting a two filament or dual intensity light bulb 12 of the type used for turn/tail/stop lamps on a motor vehicle. However, by merely eliminating the second electrical conductor track 18, or at least the arm 36 thereof, the track 10, 10A is adapted for shock mounting a single filament or intensity light bulb of the type used for a single function such as, for example, a tail lamp, or stop lamp, or turn signal lamp.

Thus, it can be readily appreciated from the above description, that the present invention eliminates electrical wiring interior of the lamp housing 14 as required by previously-known shock absorbing lamp assemblies because the light bulb mounting bracket 10 functions to both absorb shocks and also conduct electrical energy to the light bulb 12.

The foregoing detailed description is given primarly for clearness of understanding and no unnecessary limitations are to be understood therefrom for modifications will become obvious to those skilled in the art upon reading this disclosure and may be made without departing from the spirit of the invention and scope of the appended claims.

I claim:

1. An electrically conductive bracket for shock mounting a cartridge light bulb and the like in a lamp housing comprising:

(a) a plurality of electrical conductor tracks in spaced apart juxtaposition;

(b) each of the conductor tracks comprising:

a mounting flange portion to be fastened to the lamp housing to hold the conductor track in position in the lamp housing;

means for attaching the mounting flange portion to the lamp housing;

an electrical terminal strip member integrally attached to and extending outwardly from one side edge of the mounting flange portion;

a shock absorbing resilient arm having a predetermined spring constant integrally attached to and extending upwardly from the mounting flange portion; and, bulb securing means at the distal end of the arm for attachment to one end of the cartridge bulb.

2. The electrical conductive bracket of claim 1, wherein the mounting flange portion is flat.

3. The electrical conductive bracket of claim 1, further comprising webs integrally interconnecting the electrical conductor tracks together.

4. The electrical conductive bracket of claim 1, further comprising an electrical terminal integral with the distal end of the strip member of each conductor track for insertion into the female socket of the lamp housing.

5. The electrical conductive bracket of claim 4, wherein the electrical terminal depends from the distal end of the strip member.

6. The electrical conductive bracket of claim 1, wherein each of the arms is configured to provide a spring constant in the X-axis equal to the spring constant in the Y-axis.

7. The electrical conductive bracket of claim 1, wherein each arm is formed with at least one curve along its length.

8. The electrical conductive bracket of claim 1, further comprising supplemental damper means associated with each arm.

9. An electrical conductive bracket for shock mounting a cartridge light bulb and the like in a lamp housing comprising:

(a) a first electrical conductor track comprising:

a mounting flange portion to be fastened to the lamp housing to hold the first conductor track in position in the lamp housing;

means for attaching the mounting flange portion to the lamp housing;

an electrical terminal strip member integrally attached to and extending outwardly from one side edge of the mounting flange portion;

a shock absorbing resilient arm having a predetermined spring constant integrally attached to and extending upwardly from the mounting flange portion; and, bulb securing means at the distal end of the arm for attachment to one end of the cartridge bulb;

(b) a second electrical conductive track in spaced apart juxtaposition to the first electrical conductor track comprising:

a mounting flange portion to be fastened to the lamp housing to hold the second conductor track in position in the lamp housing;

means for attaching the mounting flange portion to the lamp housing;

an electrical terminal strip member integrally attached to and extending outwardly from one side edge of the mounting flange portion in spaced, parallel juxtaposition to the electrical terminal strip member of the first conductor track;

a shock absorbing resilient arm having a predetermined spring constant integrally attached to and extending upwardly from the mounting flange, the distal end of the resilient arm being in general alignment with the distal end of the resilient arm of the first conductor track and spaced from the distal end of the arm of the first conductor track by a distance approximately equal to the length dimension of the cartridge bulb; and bulb securing means at the distal end of the arm of the second conductor track for attachment to the other end of the cartridge bulb.

10. The electrical conductive bracket of claim 9, further comprising webs integrally interconnecting the first electrical conductor track and the second electrical conductor track.

11. The electrical conductive bracket of claim 9, further comprising a third electrical conductor track in spaced apart juxtaposition to the first conductor track and the second conductor track comprising:

a mounting flange portion to be fastened to the lamp housing to hold the third electrical conductor track in position in the lamp housing;

means for attaching the mounting flange portion to the lamp housing;

an electrical terminal strip member integrally attached to and extending outwardly from one side edge of the mounting flange in spaced, parallel juxtaposition to the electrical terminal strip member of the second conductor track.

a shock absorbing resilient arm having a predetermined spring constant integrally attached to and extending upwardly from the mounting flange, in adjacent, spaced, parallel juxtaposition to the arm of the second conductor track, the distal end of the resilient arm being in general alignment with the distal end of the resilient arm of the first conductor track and spaced from the distal end of the arm of the first conductor track by a distance approximately equal to the length dimension of the cartridge bulb; and, bulb securing means at the distal end of the arm of the third conductor track for attachment to the same end of the bulb as the bulb securing means of the second conductor track.

12. The electrical conductive bracket of claim 11, further comprising webs integrally the second conductor track and the third conductor track.

13. A blank from which an electrical conductive bracket for shock mounting a cartridge light bulb and the like is formed, comprising:

(a) a flat, planar first electrical conductor track element comprising:

a mounting flange element;

an electrical terminal strip element integral with and extending from an edge of the mounting flange element; and, an arm element integrally formed with and extending from an edge of the mounting flange element;

(b) a flat, planar second electrical conductor track element in spaced apart, coplanar relationship to the first electrical conductor track element comprising:

a mounting flange element;

an electrical terminal strip element integral with and extending from an edge of the mounting flange element in parallel relationship to the electrical terminal strip element of the first electrical conductor track element; and an arm element integrally formed with and extending from an edge of the mounting flange element in the opposite direction of the arm element of the first electrical conductor track element.

14. The blank of claim 13, further comprising webs integrally interconnecting the first electrical conductor track lement and the second electrical conductor track element.

15. The blank of claim 13, further comprising a flat planar third electrical conductor track element in spaced apart, coplanar relationship to the first and second conductor track elements comprising:

a flat mounting flange element;

an electrical terminal strip element integral with and extending from an edge of the mounting flange element in parallel relationship to the electrical terminal strip element of the second electrical conductor track element; and, an arm element integrally formed with and extending from an edge of the mounting flange element parallel to the arm element of the second electrical conductor track element.

16. The blank of claim 15, further comprising webs integrally interconnecting the second electrical conductor track element and the third electrical conductor track element.

17. A motor vehicle lamp assembly having a cartridge type bulb, comprising:

a lamp housing;

an electrically conductive bracket fastened to the lamp housing having at least two resilient arms with their distal ends spaced apart by a distance substantially equal to the length dimension of the cartridge type bulb;

bulb securing means at the distal ends of the arms for securing the cartridge-type bulb between and spanning the distance between the distal ends of the arms; and, the arms of the bracket are oriented in a vertical plane when the lamp is on a motor vehicle.

18. A method of making an electrically conductive bracket for shock mounting a cartridge light bulb and the like in a lamp housing comprising the steps of:

forming a plurality of flat, coplanar, spaced apart electrical track elements integrally interconnected by webs, each of the electrical track elements comprising a mounting flange element, an electrical terminal strip element extending from an edge of the mounting flange element, and an arm extending from an edge of the mounting flange element;

bending the arms in one direction relative to the mounting flange element; and, bending at least the terminal ends of the terminal strip elements in the opposite direction relative to the mounting flange element.

19. A method of making a lamp assembly having a lamp housing, with a shock mounted cartridge light bulb comprising the steps of:

forming a plurality of flat, coplanar, spaced apart electrical track elements integrally interconnected by webs, each of the electrical track elements comprising a mounting flange element, and electrical terminal strip element extending from an edge of the mounting flange element, and an arm extending from an edge of the mounting flange element;

bending the arms in one direction relative to their respective mounting flange elements;

bending at least the terminal ends of the terminal strip elements in the opposite direction relative to the mounting flange element;

securing the mounting flange element to the lamp housing; and, severing the webs interconnecting the electrical track elements.

* * * * *